US008252706B2

(12) United States Patent
Zafiroglu et al.

(10) Patent No.: US 8,252,706 B2
(45) Date of Patent: Aug. 28, 2012

(54) STRETCHABLE MULTIPLE COMPONENT NONWOVEN FABRICS AND METHODS FOR PREPARING

(75) Inventors: Dimitri P. Zafiroglu, Wilmington, DE (US); Geoffrey D. Hietpas, Wilmington, DE (US); Debora Flanagan Massouda, Wilmington, DE (US); Thomas Michael Ford, Wilmington, DE (US); Patricia A. Ford, legal representative, Wilmington, DE (US)

(73) Assignee: INVISTA North America S.àr.l., Wilmington, DE (US)

( * ) Notice: Subject to any disclaimer, the term of this patent is extended or adjusted under 35 U.S.C. 154(b) by 388 days.

(21) Appl. No.: 11/364,912

(22) Filed: Mar. 1, 2006

(65) Prior Publication Data

US 2006/0148360 A1 Jul. 6, 2006

Related U.S. Application Data

(62) Division of application No. 10/318,466, filed on Dec. 13, 2002, now Pat. No. 7,036,197.

(60) Provisional application No. 60/343,442, filed on Dec. 21, 2001.

(51) Int. Cl.

| | |
|---|---|
| ***D04H 1/00*** | (2006.01) |
| ***D04H 3/00*** | (2006.01) |
| ***D04H 5/00*** | (2006.01) |

(52) U.S. Cl. ..... 442/361; 442/362; 442/363; 442/364; 428/377; 428/371

(58) Field of Classification Search ..... 442/361–364; 428/369, 371

See application file for complete search history.

(56) References Cited

U.S. PATENT DOCUMENTS

| | | | | |
|---|---|---|---|---|
| 3,423,266 | A | 1/1969 | Davies et al. | |
| 3,595,731 | A | 7/1971 | Davies et al. | |
| 3,671,379 | A | 6/1972 | Evans et al. | |
| 4,068,036 | A | 1/1978 | Stanistreet | |
| 4,999,232 | A | 3/1991 | LeVan | |
| 5,102,724 | A | 4/1992 | Okawahara et al. | |
| 5,382,400 | A | 1/1995 | Pike et al. | |
| 5,399,174 | A | 3/1995 | Yeo et al. | |
| 5,418,045 | A | 5/1995 | Pike et al. | |
| 6,548,166 | B2 * | 4/2003 | Figuly et al. | 428/370 |
| 2003/0171052 | A1 * | 9/2003 | Bansal et al. | 442/327 |

FOREIGN PATENT DOCUMENTS

| | | | |
|---|---|---|---|
| EP | 0 588 924 | A1 | 3/1994 |
| EP | 0 391 260 | B1 | 6/1994 |
| EP | 1 160 362 | A1 | 12/2001 |
| JP | 03269154 | | 11/1991 |
| JP | 05163651 | | 6/1993 |
| JP | 2001055634 | | 2/2001 |
| WO | WO 00/66821 | A1 | 11/2000 |

* cited by examiner

*Primary Examiner* — Lynda Salvatore

(74) *Attorney, Agent, or Firm* — Christina W. Geerlof

(57) ABSTRACT

A method for preparing stretchable bonded nonwoven fabrics which involves forming a substantially nonbonded nonwoven web of multiple-component continuous filaments or staple fibers which are capable of developing three-dimensional spiral crimp, activating the spiral crimp by heating substantially nonbonded web under free shrinkage conditions during which the nonwoven remains substantially nonbonded, followed by bonding the crimped nonwoven web using an array of discrete mechanical, chemical, or thermal bonds. Nonwoven fabrics prepared according to the method of the current invention have an improved combination of stretch-recovery properties, textile hand and drape compared to multiple-component nonwoven fabrics known in the art.

8 Claims, 2 Drawing Sheets

STRETCHABLE MULTIPLE COMPONENT NONWOVEN FABRICS AND METHODS FOR PREPARING

This application is a divisional of U.S. application Ser. No. 10/318,486 filed Dec. 13, 2002, now U.S. Pat. No. 7,036,197, which claims the benefit of U.S. Provisional Application No. 60/343,442, filed on Dec. 21, 2001.

BACKGROUND OF THE INVENTION

1. Field of the Invention

This invention relates to a method for preparing bonded stretchable nonwoven fabrics comprising multiple-component fibers. Nonwoven fabrics prepared according to the method of the current invention have an improved combination of elastic stretch, textile hand and drape.

2. Description of Related Art

Nonwoven webs made from multiple-component filaments are known in the art. For example, U.S. Pat. No. 3,595,731 to Davies et al. (Davies) describes bicomponent fibrous materials containing crimped fibers which are bonded mechanically by the interlocking of the spirals in the crimped fibers and bonded adhesively by melting of a low-melting adhesive polymer component. The crimp can be developed and the potentially adhesive component activated in one and the same treatment step, or the crimp can be developed first followed by activation of the adhesive component to bond together fibers of the web which are in a contiguous relationship. The crimp is developed under conditions where no appreciable pressure is applied during the process that would prevent the fibers from crimping.

U.S. Pat. No. 5,102,724 to Okawahara et al. (Okawahara) describes the finishing of nonwoven fabrics comprising bicomponent polyester filaments produced by conjugate spinning of side-by-side filaments of polyethylene terephthalate copolymerized with a structural unit having a metal sulfonate group and a polyethylene terephthalate or a polybutylene terephthalate. The filaments are mechanically crimped prior to forming a nonwoven fabric. The fabric is rendered stretchable by exposure to infrared radiation while the filaments are in a relaxed state. During the infrared heating step, the conjugate filaments develop three-dimensional crimp. One of the limitations of this process is that it requires a separate mechanical crimping process in addition to the crimp developed in the heat treatment step. In addition, the process of Okawahara requires the web or fabric to be in continuous contact with a conveyor such as a bar conveyor or a pre-gathering slot along spaced lines corresponding to the bars in the bar conveyor or lines of contact where the web contacts the gathering slot, as the product is shrunk or prepared for shrinking. Processing through a pre-gathering slot requires the use of cohesive fabrics that are pre-integrated and cannot be used with the substantially nonbonded nonwoven webs that are used in the current invention. Multiple-line contact with a bar conveyor during the shrinkage step interferes with fabric shrinkage and crimp development, even when the fabric is overfed onto the conveyor.

U.S. Pat. No. 5,382,400 to Pike et al. (Pike) describes a process for making a nonwoven fabric which includes the steps of melt-spinning continuous multiple-component polymeric filaments, drawing the filaments, at least partially quenching the multiple-component filaments so that the filaments have latent helical crimp, activating the latent helical crimp, and thereafter forming the crimped continuous multiple-component filaments into a nonwoven fabric. The resulting nonwoven fabric is described as being substantially stable and uniform and may have high loft.

PCT Published Application No. WO 00/66821 describes stretchable nonwoven webs that comprise a plurality of bicomponent filaments that have been point-bonded prior to heating to develop crimp in the filaments. The bicomponent filaments comprise a polyester component and another polymeric component that is preferably a polyolefin or polyamide. The heating step causes the bonded web to shrink resulting in a nonwoven fabric which exhibits elastic recovery in both the machine direction and the cross direction when stretched up to 30%. Since the length of fiber segments between the bond points varies, pre-bonding of the fabric prior to shrinkage does not allow equal and unimpeded crimp development among all of the bicomponent filaments since the shrinking stresses are unequally distributed among the filaments. As a result, overall shrinkage, shrinkage uniformity, crimp development, and crimp uniformity are reduced.

U.S. Pat. No. 3,671,379 to Evans et al. (Evans) describes self-crimpable composite filaments that comprise a laterally eccentric assembly of at least two synthetic polyesters. The composite filaments are capable of developing a high degree of helical crimp against the restraint imposed by high thread count woven structures, which crimp potential is unusually well retained despite application of elongating stress and high temperature. The composite filaments increase, rather than decrease, in crimp potential when annealed. The filaments are described as being useful in knitted, woven, and nonwoven fabrics. Preparation of continuous filament and spun staple yarns and their use in knitted and woven fabrics is demonstrated.

While stretchable nonwoven fabrics from multiple-component filaments are known in the art, there exists a need for a method for producing uniform stretchable nonwoven fabrics from multiple-component filaments which have an improved combination of uniformity, drape, and stretchability and which also have high retractive power without requiring a separate mechanical crimping step.

BRIEF SUMMARY OF THE INVENTION

This invention is directed to a method for preparing a stretchable nonwoven fabric that comprises the steps of:

forming a substantially nonbonded nonwoven web comprising multiple-component fibers, the multiple-component fibers being capable of developing three-dimensional spiral crimp upon heating;

heating the substantially nonbonded nonwoven web under free shrinkage conditions to a temperature sufficient to cause the multiple-component fibers to develop three-dimensional spiral crimp and to cause the substantially nonbonded nonwoven web to shrink, the heating temperature being selected such that the heat-treated nonwoven web remains substantially nonbonded during the heating step; and bonding the heat-treated nonwoven web with an array of discrete bonds to form the stretchable bonded nonwoven fabric.

This invention is also directed to a nonwoven bonded fabric comprising multiple-component fibers with three-dimensional spiral crimp after heating and having no greater than about 5% permanent set when its highest level of stretch is at least 12%, and preferably 20%.

DETAILED DESCRIPTION OF THE INVENTION

Figure 1:
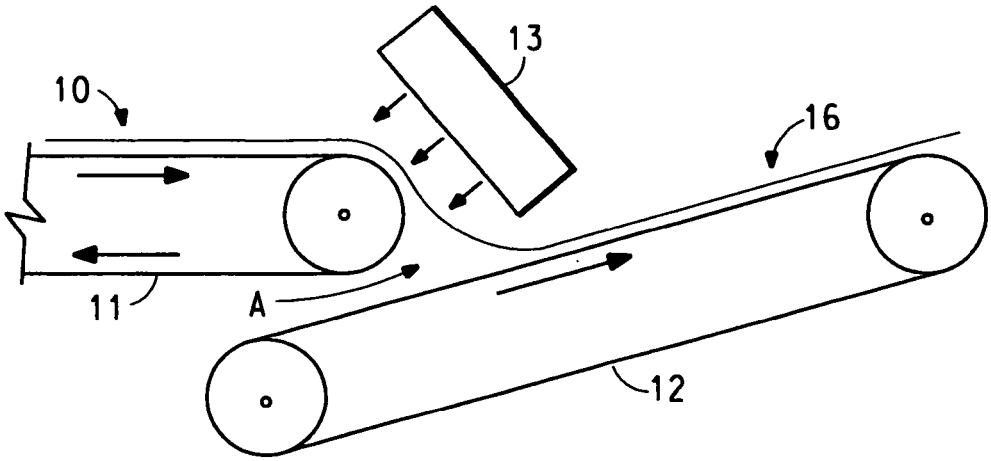
FIG. 1 is a schematic diagram of a side view of an apparatus suitable for carrying out the heat-shrinkage step in a first embodiment of the process of the current invention in which the web is allowed to free fall from a first conveyor onto a second conveyor with the heating step being conducted while the web is in a free fall state.

The present invention is directed toward a method for forming stretchable nonwoven fabrics comprising multiple-component fibers. The method involves forming a substantially nonbonded web of fibers comprising at least 30 weight percent, and preferably at least 40 weight percent, of laterally eccentric multiple-component fibers having latent spiral crimp followed by activating the spiral crimp by heating under "free shrinkage" conditions which allows the fibers to crimp substantially equally and uniformly without being hindered by inter-fiber bonds, mechanical friction between the web and other surfaces, or other effects that might hinder crimp formation. The laterally eccentric fibers can be combined with other fibers in staple form by pre-blending before forming webs or by lightly intermeshing webs containing laterally eccentric and non-eccentric cross-section staple fibers. In filament form, the laterally eccentric fibers can be intermixed with other filaments, or they can be intermeshed into staple webs or filament webs of other fibers. The crimped web is preferably bonded with a discrete pattern of bonds at selected points, lines, or intervals, resulting in an elastic, conformable, and drapeable bonded nonwoven fabric.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. A common example of a polyester is poly(ethylene terephthalate) which is a condensation product of ethylene glycol and terephthalic acid.

The terms "nonwoven fabric", "nonwoven web", and "nonwoven layer" as used herein mean a textile structure of individual fibers, filaments, or threads that are directionally or randomly oriented and optionally bonded by friction, and/or cohesion and/or adhesion, as opposed to a regular pattern of mechanically inter-engaged fibers, i.e. it is not a woven or knitted fabric. Examples of nonwoven fabrics and webs include spunbond continuous filament webs, carded webs, air-laid webs, and wet-laid webs. Suitable bonding methods include thermal bonding, chemical or solvent bonding, resin bonding, mechanical needling, hydraulic needling, stitch-bonding, etc.

The terms "multiple-component filament" and "multiple-component fiber" as used herein refer to any filament or fiber that is composed of at least two distinct polymers which have been spun together to form a single filament or fiber. The process of the current invention may be conducted using either short (staple) fibers or continuous filaments in the nonwoven web. As used herein the term "fiber" includes both continuous filaments and discontinuous (staple) fibers. By the term "distinct polymers" it is meant that each of the at least two polymeric components are arranged in distinct substantially constantly positioned zones across the cross-section of the multiple-component fibers and extend substantially continuously along the length of the fibers. Multiple-component fibers are distinguished from fibers that are extruded from a homogeneous melt blend of polymeric materials in which zones of distinct polymers are not formed. The at least two distinct polymeric components useable herein can be chemically different or they can be chemically the same polymer, but have different physical characteristics, such as tacticity, intrinsic viscosity, melt viscosity, die swell, density, crystallinity, and melting point or softening point. One or more of the polymeric components in the multiple-component fiber can be a blend of different polymers. Multiple-component fibers useful in the current invention have a laterally eccentric cross-section, that is, the polymeric components are arranged in an eccentric relationship in the cross-section of the fiber. Preferably, the multiple-component fiber is a bicomponent fiber that is made of two distinct polymers and has an eccentric sheath-core or a side-by-side arrangement of the polymers. Most preferably, the multiple-component filament is a side-by-side bicomponent filament. If the bicomponent filament has an eccentric sheath-core configuration, the polymer having the lower melting or softening point is preferably in the sheath to facilitate thermal point bonding of the nonwoven fabric after it has been heat treated to develop three-dimensional spiral crimp. The term "multiple-component web" as used herein refers to a nonwoven web comprising multiple-component fibers. The term "bicomponent web" as used herein refers to a nonwoven web comprising bicomponent fibers. The multiple-component and bicomponent webs can comprise blends of multiple-component fibers with single component fibers.

The term "spunbond" fibers as used herein means fibers which are formed by extruding molten thermoplastic polymer material as fibers from a plurality of fine, usually circular, capillaries of a spinneret with the diameter of the extruded filaments then being rapidly reduced by drawing. Other fiber cross-sectional shapes such as oval, multi-lobal, etc. can also be used. Spunbond fibers are generally continuous filaments and have an average diameter of greater than about 5 micrometers. Spunbond nonwoven fabrics or webs are formed by laying spunbond fibers randomly on a collecting surface such as a foraminous screen or belt using methods known in the art. Spunbond webs are generally bonded by methods known in the art such as by thermally point bonding the web at a plurality of discrete thermal bond points, lines, etc. located across the surface of the spunbond fabric.

The term "substantially nonbonded nonwoven web" is used herein to describe nonwoven webs in which there is little or no inter-fiber bonding. It is important in the process of certain embodiments of the current invention that the fibers in the multiple-component nonwoven web are not bonded to any significant degree prior to and during activation of the three-dimensional spiral crimp so that development of the crimp during heat treatment is not hindered by restrictions imposed by bonding. In some instances, it may be desirable to pre-consolidate the web at low levels prior to heat treatment in order to improve the cohesiveness or handleability of the web. However, the degree of pre-consolidation should be low enough that the percent area shrinkage of the pre-consolidated multiple-component nonwoven web during heat treatment is at least 90%, preferably 95%, of the area shrinkage of an identical multiple-component nonwoven web that has not been pre-consolidated prior to crimp development and which is subjected to heat treatment under identical conditions. Pre-consolidation of the web can be achieved using very light mechanical needling or by passing the unheated fabric through a nip, preferably a nip of two intermeshing rolls.

As used herein, the term "elastic" when applied to a nonwoven fabric or multi-layer composite sheet means that when the fabric or composite sheet is stretched by at least 12% of its original length and then released, that the nonwoven fabric or composite sheet recovers so that the residual elongation (or permanent set) after release of the stretching force is no greater than 5%, calculated based on the original length of the nonwoven fabric or composite sheet prior to stretching. For example, a sheet with a length of 10 inches can be elongated to at least 11.2 inches by application of a stretching force. When the stretching force is released, the sheet should retract to a new permanent length that is not in excess of 10.5 inches. Other methods for expressing and measuring elasticity are provided in greater detail below immediately preceding the Examples.

Laterally eccentric multiple-component fibers comprising two or more synthetic components that differ in their ability to shrink are known in the art. Such fibers form spiral crimp when the crimp is activated by subjecting the fibers to shrinking conditions in an essentially tensionless state. The amount of crimp is directly related to the difference in shrinkage between the components in the fibers. When the multiple-component fibers are spun in a side-by-side conformation, the crimped fibers that are formed after crimp activation have the higher-shrinkage component on the inside of the spiral helix and the lower-shrinkage component on the outside of the helix. Such crimp is referred to herein as spiral crimp. Such crimp is distinguished from mechanically crimped fibers, such as stuffer-box crimped fibers, which generally have two-dimensional crimp.

A variety of thermoplastic polymers may be used to form the components of multiple-component fibers that are capable of developing three-dimensional spiral crimp. Examples of combinations of such thermoplastic resins suitable for forming spirally crimpable, multiple-component fibers are crystalline polypropylene/high density polyethylene, crystalline polypropylene/ethylene-vinyl acetate copolymers, polyethylene terephthalate/high density polyethylene, poly(ethylene terephthalate)/poly(trimethylene terephthalate), poly(ethylene terephthalate)/poly(butylene terephthalate), and nylon 66/nylon 6.

In a preferred embodiment, at least a portion of the surface of the multiple-component fibers forming the nonwoven web are made from a polymer that is heat bondable. By heat bondable, it is meant that when the multiple-component fibers forming the nonwoven web are subjected to heat and/or ultrasonic energy of a sufficient degree, the fibers will adhere to one another at the bonding points where heat is applied due to the melting or partial softening of the heat-bondable polymer. The polymeric components are preferably chosen such that the heat bondable component has a melting temperature that is at least about 10° C. less than the melting point of the other polymeric components. Suitable polymers for forming such heat bondable fibers are permanently fusible and are typically referred to as being thermoplastic. Examples of suitable thermoplastic polymers include, but are not limited to polyolefins, polyesters, polyamides, and can be homopolymers or copolymers, and blends thereof.

To achieve high levels of three dimensional spiral crimp, the polymeric components of the multiple-component fibers are preferably selected according to the teaching in Evans, which is hereby incorporated by reference. The Evans patent describes bicomponent fibers in which the polymeric components are partly crystalline polyesters, the first of which has chemical repeat-units in its crystalline region that are in a non-extended stable conformation that does not exceed 90 percent of the length of the conformation of its fully extended chemical repeat units, and the second of which has chemical repeat-units in its crystalline region which are in a conformation more closely approaching the length of the conformation of its fully extended chemical repeat-units than the first polyester. The term "partly crystalline" as used in defining the filaments of Evans serves to eliminate from the scope of the invention the limiting situation of complete crystallinity where the potential for shrinkage would disappear. The amount of crystallinity, defined by the term "partly crystalline" has a minimum level of only the presence of some crystallinity (i.e., that which is first detectable by X-ray diffraction means) and a maximum level of any amount short of complete crystallinity. Examples of suitable fully extended polyesters are poly(ethylene terephthalate), poly (cyclohexyl 1,4-dimethylene terephthalate), copolymers thereof, and copolymers of ethylene terephthalate and the sodium salt of ethylene sulfoisophthalate. Examples of suitable non-extended polyesters are poly(trimethylene terephthalate), poly (tetramethylene terephthalate), poly(trimethylene dinaphthalate), poly(trimethylene bibenzoate), and copolymers of the above with ethylene sodium sulfoisophthalate, and selected polyester ethers. When ethylene sodium sulfoisophthalate copolymers are used, it is preferably the minor component, i.e. present in amounts of less than 5 mole percent and preferably present in amounts of about 2 mole percent. In an especially preferred embodiment, the two polyesters are poly (ethylene terephthalate) and poly(trimethylene terephthalate). The bicomponent filaments of Evans have a high degree of spiral crimp, generally acting as springs, having a recoil action whenever a stretching force is applied and then released. Other partly crystalline polymers which are suitable for use in the current invention include syndiotactic polypropylene which crystallizes in an extended conformation and isotactic polypropylene which crystallizes in a non-extended, helical conformation.

Substantially nonbonded webs of multiple-component staple fibers can be prepared using methods known in the art such as carding or garnetting, which provide a nonwoven web in which the multiple-component staple fibers are oriented predominantly in one direction. The web should contain at least 30 weight percent, and preferably at least 40 weight percent, of multiple-component fibers. Preferably, the staple fibers have a denier per filament (dpf) between about 0.5 and 6.0 and a fiber length of between about 0.5 inch (1.27 cm) and 4 inches (10.1 cm). In order to be processed in a carding apparatus, the multiple-component staple fibers preferably have an initial helical crimp level characterized by a Crimp Index (CI) that is no greater than about 45% and preferably in the range of about 8% to 15%. Methods for determining these crimp values are provided below preceding the Examples.

Alternately, the multiple-component fibers can be mechanically crimped. However, it has been found that when multiple-component fibers are spun under conditions which provide fibers having zero initial crimp and which are then mechanically crimped and formed into a carded web, the resulting nonwoven fabrics have lower levels of stretch after heat treatment than those prepared from fibers having an initial spiral crimp level as described above.

The polymeric components in the multiple-component fibers are preferably selected such that there is no significant separation of the components during the carding process. The web obtained from a single card or garnet is preferably superimposed on a plurality of such webs to build up the web to a sufficient thickness and uniformity for the intended end use. The plurality of layers may also be laid down such that alternate layers of carded webs are disposed with their fiber orientation directions disposed at a certain angle to form a cross-lapped (or cross-laid) web. For example, the layers may be disposed at 90 degrees with respect to intervening layers. Such cross-laid webs have the advantage of reducing the difference in strength level in at least two directions and achieving a balance of stretchability.

Random or isotropic multiple-component staple fiber webs may be obtained by using conventional air-laying methods where multiple-component staple fibers are discharged into an air stream and guided by the current of air to a foraminous surface on which the fibers settle. The nonwoven web comprises at least about 30 percent by weight, and preferably at least 40 percent by weight, of multiple-component fibers capable of developing spiral crimp. The nonwoven web can comprise 100% multiple-component fibers. Staple fibers suitable for use in blends with the spirally crimpable multiple-component fibers include natural fibers such as cotton, wool, and silk and synthetic fibers including polyamide, polyester, polyacrylonitrile, polyethylene, polypropylene, polyvinyl alcohol, polyvinyl chloride, polyvinylidene chloride, and polyurethane fiber. Webs of eccentric multiple-component staple fibers can also be intermeshed by pressing, light calendering or very light needlepunching with staple webs of other fibers prior to "free-shrinking". The web can be lightly pro-consolidated to improve the web cohesiveness and handleability, such as by mechanical needling or by passing the fabric through a nip formed by two smooth rolls or two intermeshing rolls. The degree of pre-consolidating should be low enough that the nonwoven web remains substantially nonbonded, that is so that the area shrinkage of the pre-consolidated web is at least 90% of the area shrinkage of an identical nonwoven web that has not been pre-consolidated. The heat treatment step can be conducted in-line or the staple web can be wound up and heat-treated in subsequent processing of the web.

Multiple-component continuous filament webs can be prepared using spunbond processes known in the art. For example, a web comprising multiple-component continuous filaments can be prepared by feeding two or more polymer components as molten streams from separate extruders to a spinneret comprising one or more rows of multiple-component extrusion orifices. The spinneret orifices and spin pack design are chosen so as to provide filaments having the desired cross-section and denier per filament (dpf). The continuous filament multiple-component web preferably comprises at least 30 weight percent, more preferably at least 40 weight percent, of multiple-component filaments capable of developing three-dimensional spiral crimp. Preferably, the filaments have a denier per filament of between about 0.5 and 10.0. The spunbond multiple-component continuous filaments preferably have an initial helical crimp level characterized by a Crimp Index (CI) that is no greater than about 60%. The spirally crimped fibers (whether staple or continuous) are characterized by a Crimp Development (CD) value, wherein the quantity (% CD−% CI) is greater than or equal to 15% and more preferably greater than or equal to 25%.

When the filaments are bicomponent filaments, the ratio of the two polymeric components in each filament is generally between about 10:90 and 90:10 based on volume (for example, measured as a ratio of metering pump speeds), more preferably between about 30:70 and 70:30, and most preferably between about 40:60 and 60:40.

Separate spin packs can be used to provide a mixture of different multiple-component filaments in the web, where different filaments are spun from different spin packs. Alternately, single component filaments can be spun from one or more spin packs to form a spunbond nonwoven web comprising both single component and multiple-component filaments.

The filaments exit the spinneret as a downwardly moving curtain of filaments and pass through a quench zone where the filaments are cooled, for example, by a cross-flow air quench supplied by a blower on one or both sides of the curtain of filaments. The extrusion orifices in alternating rows in the spinneret can be staggered with respect to each other in order to avoid "shadowing" in the quench zone, where a filament in one row blocks a filament in an adjacent row from the quench air. The length of the quench zone is selected so that the filaments are cooled to a temperature such that the filaments do not stick to each other upon exiting the quench zone. It is not generally required that the filaments be completely solidified at the exit of the quench zone. The quenched filaments generally pass through a fiber draw unit or aspirator that is positioned below the spinneret. Such fiber draw units or aspirators are well known in the art and generally include an elongate vertical passage through which the filaments are drawn by aspirating air entering from the sides of the passage and flowing downwardly through the passage. The aspirating air provides the draw tension which causes the filaments to be drawn near the face of the spinneret plate and also serves to convey the quenched filaments and deposit them on a foraminous forming surface positioned below the fiber draw unit.

Alternately, the fibers may be mechanically drawn using driven draw rolls interposed between the quench zone and the aspirating jet. In that case, the draw tension which causes the filaments to be drawn close to the spinneret face is provided by the draw rolls and the aspirating jet serves as a forwarding jet to deposit the filaments on the web forming surface below. A vacuum can be positioned below the forming surface to remove the aspirating air and draw the filaments against the forming surface.

In conventional spunbonding processes, the web is usually bonded in-line after the web has been formed and prior to winding the web up on a roll, for example, by passing the nonbonded web through the nip of a heated calender. In the current invention, the spunbond web is left in a substantially nonbonded state during and after heat treatment to activate the three-dimensional spiral crimp. Preconsolidation is not generally required for spunbond webs in the process of the current invention because the nonbonded spunbond webs usually have sufficient cohesiveness to be handled in subsequent process steps. However, the web can be consolidated by cold calendering prior to heat treatment. As with staple webs, any pre-consolidating should be at sufficiently low levels so that the continuous filament web remains substantially nonbonded. The heat treatment can be conducted in-line or the substantially nonbonded web can be rolled up and heat-treated in later processing.

The eccentric multiple-component spunbond filaments can also be mixed with other co-spun filaments during the spunbonding process, or the spunbond web can be intermeshed with another staple or filament web by pressing, light calendering, or light needlepunching to intermesh the filaments prior to the free-shrinking process.

The substantially nonbonded nonwoven web (made from either continuous filament or staple fiber) is heat-treated under conditions that allow the web to shrink under "free shrinkage" conditions. By "free shrinkage" conditions it is meant that there is no substantial contact between the web and surfaces that would restrict the shrinkage of the web. That is, there are no substantial mechanical forces acting on the web to interfere with or retard the shrinking process. In the process of the current invention, the fabric preferably does not contact any surface while it is shrinking during heat treatment. Alternately, any surface that is in contact with the nonwoven web during the heat treatment step is moving at substantially the same speed as that of the continuously shrinking nonwoven web so as to minimize frictional forces which would otherwise interfere with the nonwoven web shrinkage. "Free shrinkage" also specifically excludes processes in which the nonwoven web is allowed to shrink by heating in a liquid medium since the liquid will impregnate the fabric and interfere with the motion and shrinkage of the fibers. The shrinking (heating) step of the process of the current invention can be conducted in atmospheric steam or other heated gaseous medium.

FIG. 1 shows a schematic side view of an apparatus suitable for carrying out the heat-shrinkage step in a first embodiment of the process of the current invention. Substantially nonbonded nonwoven web 10 comprising multiple-component fibers having latent spiral crimp is conveyed on a first belt 11 moving at a first surface speed to transfer zone A where the web is allowed to fall freely until it contacts the surface of a second belt 12 which is moving at a second surface speed. The surface speed of the second belt is less than the surface speed of the first belt. As the substantially nonbonded web leaves the surface of belt 11, it is exposed to heat from heater 13 as it free-falls through the transfer zone. Heater 13 can be a blower for providing hot air, an infrared heat source, or other heat sources known in the art such as microwave heating. The substantially nonbonded web is heated in transfer zone A to a temperature which is sufficiently high to activate the latent spiral crimp of the multiple-component fibers and cause the web to shrink, while being essentially free of any external interfering forces. The temperature of the web in the transfer zone and the distance the web free-falls in the transfer zone prior to contacting belt 12 are selected such that the desired web shrinkage is essentially complete by the time the heat-treated web contacts belt 12. The temperature in the transfer zone should be selected such that the web remains substantially nonbonded during heat treatment. When the web initially leaves belt 11, it is travelling at the same speed as the surface speed of the belt. As a result of the web shrinkage resulting from activation of the latent spiral crimp of the multiple-component fibers by the heat applied in the transfer zone, the speed of the web decreases as it travels through transfer zone A. The surface speed of belt 12 is selected to match as closely as possible the speed of the web when it leaves transfer zone A and initially contacts belt 12. The heat-treated web 16 can be thermally point bonded by passing through a heated calender comprising two rolls (not shown), one of which is patterned with the desired point bonding pattern. The bonding rolls are preferably driven at a surface speed that is slightly less than the speed of belt 12 to avoid drawing the web. After free-shrinking, the web can also be bonded by heating to a temperature that melts part of the surface(s) of the fibers, by melting low-melt fibers blended with the main fibers, by activating the surface of the fibers using chemical means, or by impregnating the web with a suitable flexible liquid binder. Alternately, the heat-treated substantially nonbonded multiple-component nonwoven web can be wound up without bonding and bonded during subsequent processing of the web.

Figure 2:
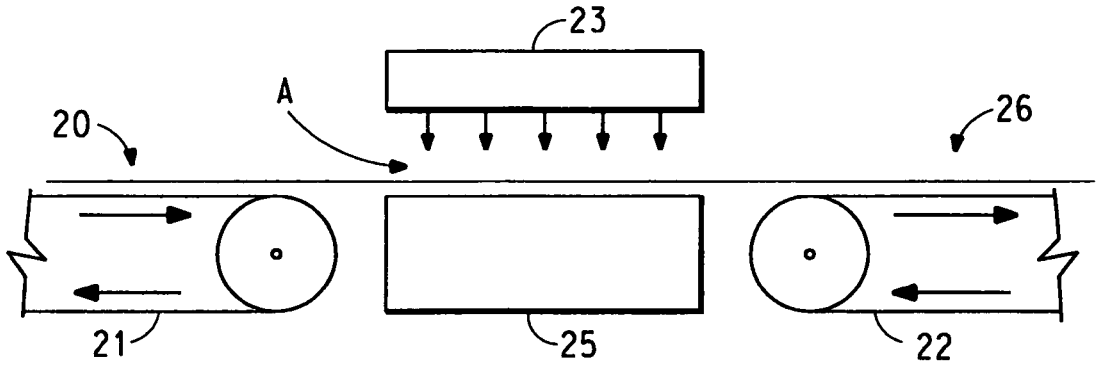
FIG. 2 is a schematic diagram of a side view of an apparatus suitable for carrying out the heat-shrinkage step in a second embodiment of the process of the current invention in which the web is floated on a gaseous layer in a transfer zone between two conveying belts.

FIG. 2 shows an apparatus for use in the heat shrinkage step of a second embodiment of the current invention. Substantially nonbonded nonwoven web 20 comprising multiple-component fibers having latent spiral crimp is conveyed on a first belt 21 which has a first surface speed to transfer zone A where it is floated on a gas, such as air, and then transferred to a second belt 22 which has a second surface speed. The second surface speed is less than the first surface speed. The air is provided through openings in the upper surface of an air supply box 25 to float the web as it is conveyed through the transfer zone. The air provided to float the web can be at room temperature (approximately 25° C.) or pre-heated to contribute to the web shrinkage. Preferably, the air emanates from small densely spaced openings in the upper surface of the air supply box to avoid disturbing the web. The web can also be floated on the air currents generated by small vanes attached to rollers placed under the web. The floating web is heated in transfer zone A by radiant heater 23 to a temperature that is sufficient to activate the latent spiral crimp of the multiple-component fibers, causing the web to shrink while remaining substantially nonbonded. The temperature of the web in the transfer zone and the distance the web travels in the transfer zone are selected such that the desired web shrinkage is essentially complete prior to contacting second belt 22. The surface speed of the second belt is selected to match as closely as possible the surface speed of the heat-treated web 26 as it exits transfer zone A.

Figure 3:
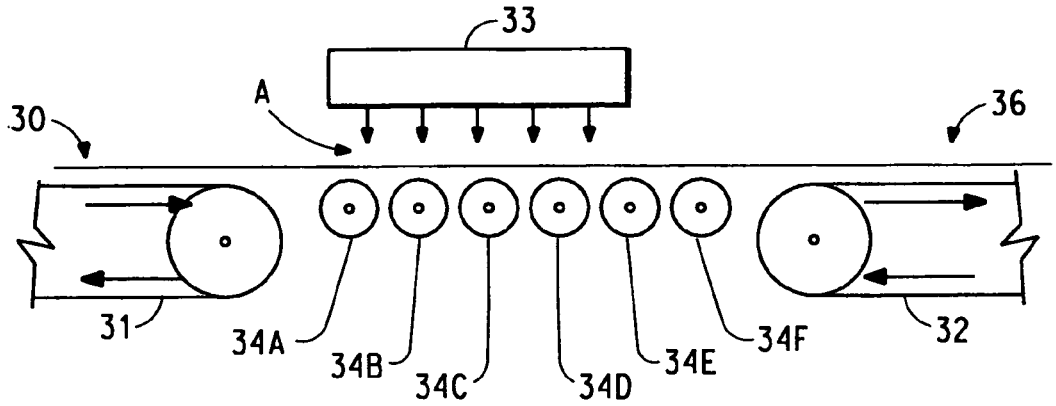
FIG. 3 is a schematic diagram of a side view of an apparatus suitable for carrying out the heat-shrinkage step in a third embodiment of the process of the current invention in which the web is supported during heating on a series of driven rotating rolls.

FIG. 3 shows an apparatus for use in the heat shrinkage step of a third embodiment of the current invention. Substantially nonbonded nonwoven web 30 comprising multiple-component fibers having latent spiral crimp is conveyed on a first belt 31 having a first surface speed to transfer zone A comprising a series of driven rolls 34A through 34F. The web is conveyed through transfer zone A to belt 32 moving at a second surface speed that is lower than the first surface speed of belt 31. Although, six rolls are shown on the figure, at least two rolls are required. However, the number of rolls can vary depending on the operating conditions and the particular polymers used in the multiple-component fibers. The substantially nonbonded nonwoven web is heated in transfer zone A by heater 33 to a temperature that is sufficient to activate the spiral crimp of the multiple-component fibers, causing the web to shrink while remaining substantially nonbonded. The temperature of the web in the transfer zone and the distance the web travels in the transfer zone are selected such that the desired web shrinkage is essentially complete prior to contacting second belt 32. As the web shrinks, the surface speed of the web decreases as it is conveyed through the transfer zone. Rolls 34A through 34F are driven at progressively slower peripheral linear speeds in the direction moving from belt 31 to belt 32, with the surface speeds of the individual rolls being selected such that the peripheral linear speed of each roll is within 2-3% of the speed of the web as it contacts the roll. Because the rate at which the web shrinks is generally not known and is dependent upon the web construction, polymers used, process conditions, etc., the speeds of the individual rolls 34A through 34F can be determined by adjusting the speed of each roll during the process to maximize the web shrinkage and minimize non-uniformities in the web. The surface speed of the second belt 32 is selected to match as closely as possible the speed of the heat-treated web 36 as it exits transfer zone A and initially contacts the belt.

Figure 4:
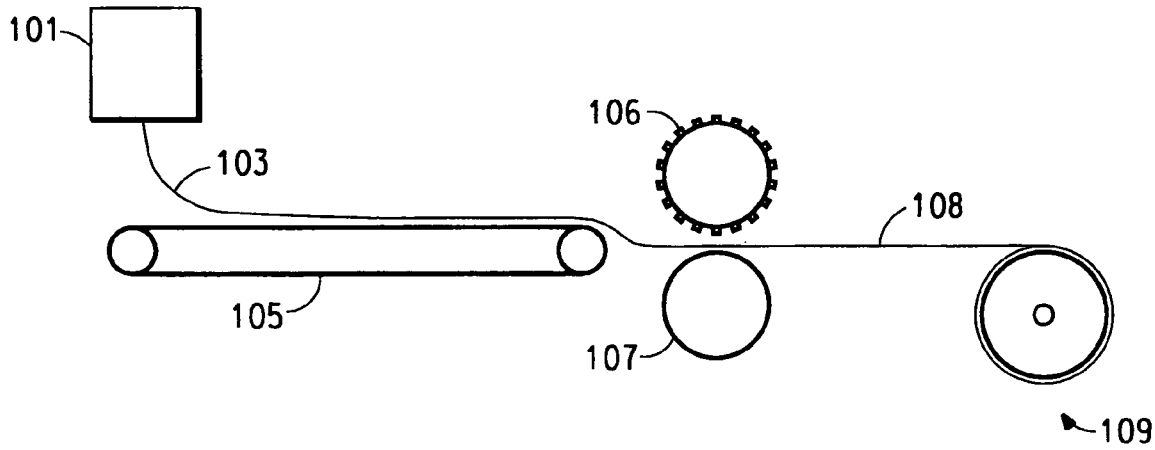
FIG. 4 is a schematic diagram of a side view of an apparatus suitable for carrying out the heat-shrinkage step in a fourth embodiment of the process of the current invention.

FIG. 4 is a schematic diagram of a process for forming a bi-layer composite nonwoven fabric according to the current invention, but using a simpler embodiment in the heat shrinkage step. Spirally-crimpable nonwoven layer 103 is supplied from a web source 101, such as a carding machine, supply roll, etc. and laid onto conveyor belt 105. The web is passed in the nip of a set of thermal bonding rolls 106 and 107. Roll 106 is shown as a patterned roll and roll 107 is a smooth roll and both rolls are heated to about 200 C. Belt 105 travels at a speed higher than the surface speed of rolls 106 and 107 so as to avoid undesired tension on the web entering the nip of rolls 106 and 107 as the web shrinks prior to the nip. In this embodiment, the free shrinkage step is accomplished by a combination of the relatively slow speed of the belt 105 and the radiant heat from the rolls 106 and 107. As such, a separate heating station 13 as depicted in FIG. 1, for example, is not required, and the product has minimum elongation. As it exits rolls 106 and 107, the heat-treated, shrunk composite fabric 108 is then wound up as a finished product on wind-up roll 109.

The heating time for the crimp-activation step is preferably less than about 10 seconds. Heating for longer periods requires costly equipment. The web is preferably heated for a time sufficient for the fibers to develop at least 90% of their full latent helical crimp. The web can be heated using a number of heating sources including microwave radiation, hot air, and radiant heaters. The web is heated to a temperature sufficient to activate the spiral crimp, but which is still below the softening temperature of the lowest melting polymeric component such that the web remains substantially nonbonded during crimp development. The temperature for activating the spiral crimp should be no higher than 20° C. below the onset of the melting transition temperature of the polymers as determined by Differential Scanning Calorimetry. This is to avoid premature interfiber bonding in those embodiments where the bonding is separate from the heating step. After the crimp has been activated, the web has generally shrunk in area by at least about 10 to 75% percent, preferably by at least 25 percent, and more preferably at least 40%.

After the multiple-component, substantially nonbonded, nonwoven web is heat treated to activate the three-dimensional spiral crimp and shrink the web, the web is bonded at discrete bond points across the fabric surface to form a cohesive nonwoven fabric. The bonding may be conducted in-line following the heating step or the substantially nonbonded, heat-treated, nonwoven fabric can be collected, such as by winding on a roll, and bonded in subsequent processing. In a preferred embodiment, thermal point bonding or ultrasonic bonding is used. Typically, the thermal bonding involves applying heat and pressure at discrete spots on the fabric surface, for example, by passing the nonwoven layer through a nip formed by a heated, patterned calender roll and a smooth roll. During thermal bonding, the fibers are melted in discrete areas corresponding to raised protuberances on the heated patterned roll to form fusion bonds which hold the nonwoven layers of the composite together to form a cohesive, bonded nonwoven fabric. The pattern of the bonding roll may be any of those known in the art and are preferably discrete point bonds. The bonding may be in continuous or discontinuous patterns, uniform or random points or a combination thereof. Preferably, the point bonds or line bonds are spaced less than 0.25 cm apart at about 4 to 16 per centimeter, and preferably 4 to 8 per centimeter with a bond density of about 16 to 62 bonds/cm$^2$. The bond points can be round, square, rectangular, triangular or other geometric shapes and the percent bonded area can vary between about 5 to 50% of the surface of the nonwoven fabric. The distance between adjacent bonds can be adjusted to control the level of stretch in the fabric and optimized to a particular desired stretch level. The upper limit of bond spacing should be approximately the length of the staple fiber. The lower limit would be a distance greater than the limiting case of 100% bond area coverage, in which case maximum strength would be achieved, but with virtually no stretch.

Alternately, the heat-treated nonwoven web can be bonded using liquid binders. For example, latex can be applied by printing in a pattern on the nonwoven web. The liquid binder is preferably applied to the nonwoven web such that it forms bonds that extend through the entire thickness of the web. Alternately, coarse binder fibers or binder particles can be dispersed into the web and bonded using smooth heated calender rollers. Preferably, the binder particles or fibers have dimensions of at least 0.2 mm to about 2 mm in at least one direction and are added to the web at levels to provide between about 20 and 400 bonds/in$^2$. Due to the relatively large size of the binder particles or fibers, the bonds will be visible as discrete bonds on the surface of the nonwoven web. The low-melt binder particles typically amount to 5-25% of the product weight. The thermal bonding conditions should be controlled such that the fabric is not excessively heated at the bond points that can create pinholes and reduce the barrier properties of the fabric. Other methods of bonding that can be used include chemical pattern bonding and mechanical needling. A needling pattern can be achieved using needle plates that can place several needles on the same spot by being synchronized with the web motion.

The bonded, multiple-component nonwoven fabrics prepared using the process of the current invention are elastically stretchable and have greater elastic stretch than multiple-component nonwoven fabrics that have been bonded prior to or at the same time as heat shrinkage of the web.

TEST METHODS

In the description above and in the examples that follow, the following test methods were employed to determine various reported characteristics and properties. ASTM refers to the American Society for Testing and Materials.

Crimp Level Measurement

Crimp properties for the multiple-component fibers used in the examples were determined according to the method disclosed in Evans. This method comprises making three length measurements on a wrapped bundle of the multiple-component fiber in filament form (this bundle is referred to as a skein). These three length measurements are then used to calculate three parameters that describe the crimp behavior of the multiple-component fiber.

The analytical procedure consists of the following steps:

1.) Prepare a skein of 1500 denier from a package of the multiple-component fiber. Since a skein is a circular bundle, the total denier will be 3000 when analyzed as a loop.

2.) The skein is hung at one end, and a 300 gm weight is applied at the other. The skein is exercised by moving it gently up and down 4 times and the initial length of the skein (Lo) is measured.

3.) The 300 gm weight is replaced with a 4.5 gm weight and the skein is immersed in boiling water for 15 minutes.

4.) The 4.5 gm weight is then removed and the skein is allowed to air dry. The skein is again hung and the 4.5 gm weight is replaced. After exercising 4 times, the length of the skein is again measured as the quantity Lc.

5.) The 4.5 gm weight is replaced with the 300 gm weight and again exercised 4 times. The length of the skein is measured as the quantity Le.

From the quantities Lo, Lc and Le, the following quantities are calculated:

CD=Crimp development=100*(*Le*−*Lc*)/*Le*

SS=Skein Shrinkage=100*(*Lo*−*Le*)/*Lo*

CI=Crimp Index and is calculated identical to CD except step 3 is omitted in the above procedure.

Web Shrinkage Determination

This property is measured in the machine direction or cross-direction by obtaining a 10-inch (25.4-cm) long section of web with the length of the sample being measured in the machine direction or cross-direction, respectively. The sample is then heated to 80° C. for 20 seconds under relaxed conditions (i.e., in a manner such that free shrinkage may occur, such as that depicted in FIG. 1). After heating, the web is allowed to cool to room temperature and the length of the sample is measured. The % shrinkage is calculated as 100*(10"−Measured length)/10".

Basis Weight Determination

A sample is cut to the dimensions 6.75 by 6.75 inches (17.1 by 17.1 cm) and weighed. The mass in grams obtained is equal to the basis weight in oz/yd$^2$. This number may then be multiplied by 33.91 to convert to g/m$^2$.

Intrinsic Viscosity Determination

The intrinsic viscosity (IV) was determined using viscosity measured with a Viscotek Forced Flow Viscometer Y900 (Viscotek Corporation, Houston, Tex.) for the polyester dissolved in 50/50 weight % trifluoroacetic acid/methylene chloride at a 0.4 grams/dL concentration at 19° C. following an automated method based on ASTM D 5225-92.

Determination of Highest Level of Elastic Stretch

In addition to the definition of elastic above and Available Stretch and Fabric Growth as measured by TTM-074 and TTM-077, respectively, below, the elastic stretch was also evaluated in accordance with this method.

The elastic stretch of the composite sheet was measured using a strip 2 inches (5 cm) wide by 6 inches (15 cm) long. 10 cm is measured along the 15 cm length, by two marks placed 2.5 cm from each end. The sample is initially stretched by 5% (e.g., a 10 cm length is stretched to 10.5 cm) and released. Thirty seconds is allowed for the sample to recover. This procedure is then repeated on the same sample at 10%, 15%, 20%, etc. to determine the highest level of elastic stretch obtainable for the sample.

DuPont Textile Testing Method (TTM)-074 Available Stretch

Three specimens for each fabric sample are cut, each specimen measuring 60×6.5 cm. The long dimension corresponds with the stretch direction. Trim each specimen to 5 cm in width. Fold one end of the fabric to form a loop and sew a seam across the width of the specimen. At 6.5 cm from the unlooped end of the fabric, draw a line referred to as Benchmark "A". At 50 cm away from Benchmark "A", draw another line as Benchmark "B". The sample is then conditioned for at least 16 hours at 20±2 deg. C. and 65±2% relative humidity. Then, the sample is clamped at the Benchmark "A" point and hung vertically such that the sample hangs freely from the point at Benchmark "A" and below. Using the loop sewn at the non clamped end of the fabric, a load of 30N (N=newtons) is applied. The sample is exercised by allowing it to be stretched by the load for 3 seconds, and then the load is released. This is done 3 times, then the load is re-applied and the sample length (between the Benchmarks) is recorded to the nearest millimeter. The average available stretch is taken from the three fabric samples measured in this fashion.

% Available Stretch=(*ML*−*GL*)/*GL**100

ML=length between the Benchmarks at 30 N load

GL=original length between the Benchmarks

DuPont TTM-077—Fabric Growth

The information from TTM-074 must first be obtained before this test can be conducted. New specimens prepared identically to TTM-074 are prepared and then extended to 80% of the available stretch value determined in TTM-074. The specimens are held in that stretched state for 30 minutes. The specimens are then allowed to freely relax for 60 minutes at which point the fabric growth is measured and calculated.

% Fabric Growth=(*L*2*100)/*L*

L2=increase in specimen Benchmarks after the 60 minute relaxation.

L=original length between the benchmarks.

EXAMPLES

Example 1

Side-by-side, bicomponent filament yarn was prepared by conventional melt spinning of polyethylene terepthalate (2GT) having an intrinsic viscosity of 0.52 dl/g and polytrimethylene terepthalate (3GT) having an inherent viscosity of 1.00 dl/g through round 68 hole spinnerets with a spin block temperature of 255° C.-265° C. The polymer volume ratio in the filaments was controlled to 40/60 2GT/3GT by adjustment of the polymer throughput during melt spinning. The filaments were withdrawn from the spinneret at 450-550 m/min and quenched via conventional cross-flow air. The quenched filament bundle was then drawn to 4.4 times its spun length to form yarn of continuous filaments having a denier per filament of 2.2, which were annealed at 170° C., and wound up at 2100-2400 m/min. For conversion to staple fiber, several wound packages of the yarn were collected into a tow and fed into a conventional staple tow cutter to obtain staple fiber having a cut length of 1.5 inches (3.8 cm) and a CI of 13.92% and a CD value of 45.25%.

The staple was processed into a card web at 20 yd/min (18.3 m/min) forming a layer with a basis weight of 0.9 oz/yd$^2$ (30.5 g/m$^2$). Two webs were combined by laying one on top of the other with the machine directions of each layer aligned in the same direction to form a 1.8 oz/yd$^2$ (61 g/m$^2$) web. The combined, nonbonded web was rolled up with a paper layer, which was used to prevent the web from sticking to itself as it was wound upon itself.

The web was later unrolled while separating from the paper layer and heat treated using the method shown in FIG. 1. The first belt had a surface speed of 22 feet/min (6.7 m/min) and the second belt had a surface speed of 15 feet/min (4.6 m/min). The distance that the web was allowed to free-fall from the first belt to the second belt was 10 inches (25.4 cm). The web was exposed to a radiant heater placed 5 inches from the falling web, consuming approximately 200 watts per inch of width. Exposure to the radiant face was approximately 2.5 seconds (10 inches at an average speed of 20 ft/min) to activate the spiral crimp of the bicomponent fibers and cause the web to shrink. The carded web shrank by approximately 25 percent in the machine direction and 15% in the cross direction (area shrinkage was approximately 45 percent) to a weight of 2.75 oz/yd$^2$ (93.2 g/m$^2$).

The heat-treated web was thermally point bonded at a bonding speed of 20 yards/minute (18.3 m/min) by feeding the web into the nip of a pattern-bonding calender formed by one smooth roll at 208° C. and one diamond patterned roll at 202° C. having 225 raised diamond shapes (squares turned 45 degrees) per square inch. The nip pressure was 50 lbs/linear inch. The bonded web weighed 2.5 oz/yd$^2$ (84.8 g/m$^2$) and had a thickness of 3/32 inch (0.24 cm) and 20 percent bonded area. The bonded fabric was fully drapeable, as observed by placing an 18 inch×18 inch (45.7 cm×45.7 cm) sample of the nonwoven fabric over a tall cylindrical container having a diameter of 4 inches (10.16 cm) whereupon the fabric conformed under its own weight to the shape of the container over the entire surface of the fabric. The bonded nonwoven fabric had an elastic stretch of 25% in the machine direction and 35% in the cross direction and with less than 5% permanent set.

Comparative Example A

A two-layer carded web was prepared as described in Example 1 and pre-bonded through a calender bonder using the same conditions as those used to bond the heat-treated web in Example 1. A sample of the pre-bonded web having dimensions of 180 cm long by 50 cm wide was unwound from a roll onto a belt moving at approximately 15 feet/minute (4.57 m/min) and conveyed into an oven at 100° C. The web was heated for 30 seconds while the web was positioned directly on the belt of the hot frame. The web shrank by only 5 percent in the machine direction and 15 percent in the cross direction (area shrinkage of 20 percent) and had poor drapeability. The bonded fabric had an elastic stretch of only 5% in the machine direction and only 20% in the cross-direction, with poor drapeability. Close examination revealed that whereas the product of Example 1 had uniform well formed bonds, the product of example A had poorly formed bonds with a disturbed bond perimeter and uneven thickness within the bonded areas.

Example 2

The bicomponent filaments of Example 1 were cut to a length of 2.75 inches (7 cm) and blended at a level of 50 weight percent with commercial 2GT polyester staple at 0.9 denier per filament and a length of 1.45 inches (3.7 cm). The polyester was T-90S, available from E.I. du Pont de Nemours and Company, Wilmington, Del. (DuPont).

The blended fibers were processed through a standard J. D. Hollingsworth Nonwoven Card (J. D. Hollingsworth on Wheels, Greenville, S.C.) to provide a nonwoven web having a basis weight 0.7 oz/yd$^2$ (23.7 g/m$^2$). The blended web, 80 inches (203 cm) wide, was cross-lapped into a 80 inch (203 cm) wide batt weighing approximately 4.0 oz/yd$^2$ (135.6 g/m$^2$) and mechanically needled with 130 penetrations per square inch (20.2 penetrations/cm$^2$) while it was drafted in the machine direction by a ratio of 1.3/1. The resulting lightly-needled, cross-lapped web weighed approximately 3.0 oz/yd$^2$ (101.7 g/m$^2$). At this stage, the product was soft, bulky, and cohesive, with some elastic stretch, but it was quite weak and had very poor surface stability.

The lightly-pre-needled web was pre-shrunk in a manner similar to that described in Example 1 to 4.1 oz/yd$^2$ (139 g/m$^2$), contracting approximately 13% in the cross direction and 10% in the machine relative to the starting dimensions of the web. After shrinking the web was bonded at a speed of 5 yds/min (4.6 m/min) with a patterned calender-roller heated to 227° C., applying approximately 450 lb/linear inch against a smooth steel roller heated to 230° C. The patterned roller had a two-directional interrupted pattern of lines providing a bonded area of approximately 29% with the lines spaced at approximately 5/inch (2/cm). The roller gap was set at 0.002 inches (0.1 mm).

The resulting product had a soft hand, good drapeability and a hand-evaluated elastic recoverable stretch of approximately 35% in the cross-direction and 12% in the machine direction. The final weight was 4.4 oz/yd$^2$ (149.2 g/m$^2$).

The Available Stretch was 11.6% in the machine direction and 35.3% in the cross direction. The Fabric Growth was 1.6% in the machine direction and 5.6% in the cross direction.

Comparative Example B

A web was prepared according to Example 2, except that bonding was performed before thermal shrinking. Final shrinkage was approximately equal to that of Example 2 with the final weight at 4.0 oz/yd$^2$ (135.6 g/m$^2$). Hand-evaluated elastic stretch was approximately 5% XD and 0% MD. The final product was also stiffer and less drapeable than the product of Example 2. The Available Stretch was 7.2% in the machine direction and 10.6% in the cross direction. The Fabric Growth was 0.6% in the machine direction and 1.0% in the cross direction.

Example 3

The fabric of this example comprised the following blend of fibers:

50% 2GT/3GT bicomponent fiber (1.5 inches, 4.4 dpf), 3GT single component fiber (1.5 in (3.8 cm) and 1.6 dpf). The 2GT/3GT bicomponent was the same as in Example 2. The 3GT fiber was prepared from the same 3GT polymer as was used to make the bicomponent fiber and was prepared on standard staple fiber production equipment.

This example was performed with the same procedure as Example 2. The fabric had a stretch in both directions (machine and cross) of 30-35% with a 95% recovery (i.e., 5% permanent set). That is, the fabric could be stretched up to 35% and when released it returned to a final state in which it had a 5% increase over the initial unstretched length. It also had excellent drape and softness. The final basis wt. was 5.1 oz/yd$^2$ (172.9 g/m$^2$).

What is claimed is:

1. A nonwoven fabric comprising multiple-component fibers with three-dimensional spiral crimp after heating having no greater than about 5% permanent set wherein when bonded after heating the highest level of stretch of the fabric is at least 12% and wherein the bonds are spaced at about 4 to 8 bonds per cm and have a density of about 16 to 62 per cm$^2$; wherein the multiple component fibers comprise bicomponent fibers including two distinct polymers selected from the group consisting of poly(ethylene terephthalate), poly (cyclohexyl 1,4-dimethylene terephthalate), copolymers of poly (ethylene terephthalate) and poly (cyclohexyl 1,4-dimethylene terephthalate), copolymers of ethylene terephthalate and the sodium salt of ethylene sulfoisophthalate; poly(trimethylene terephthalate), poly(tetramethylene terephthalate), poly(trimethylene dinaphthalate), poly(trimethylene bibenzoate), and copolymers poly(trimethylene terephthalate), poly(tetramethylene terephthalate), poly(trimethylene dinaphthalate), and poly(trimethylene bibenzoate) with ethylene sodium sulfoisophthalate, crystalline polypropylene, high density polyethylene, ethylene-vinyl acetate copolymers, nylon 66, and nylon 6;

said bicomponent fibers having an arrangement selected from eccentric sheath-core and side-by side.

2. The nonwoven fabric of claim 1, wherein the highest level of stretch of the fabric is at least 20%.

3. The nonwoven fabric of claim 1, comprising least 30 weight percent of multiple-component fibers.

4. The nonwoven fabric of claim 3, comprising least 40 weight percent of multiple-component fibers.

5. The nonwoven fabric of claim 1, wherein the multiple-component fibers comprise bicomponent fibers of poly(ethylene terephthalate) and poly(trimethylene terephthalate).

6. The nonwoven fabric of claim 1, comprising a blend of multiple-component fibers with fibers that are not three dimensionally spirally crimped selected from the group consisting of cotton, wool, and silk and synthetic fibers including polyamide, polyester, polyacrylonitrile, polyethylene, polypropylene, polyvinyl alcohol, polyvinyl chloride, polyvinylidene chloride, and polyurethane.

7. The nonwoven fabric of claim 1, wherein available stretch in the machine direction and cross direction are at least 10% and the fabric growth is no greater than 20% of the available stretch.

8. A nonwoven fabric comprising multiple-component fibers with three-dimensional spiral crimp after heating having no greater than about 5% permanent set wherein when bonded after heating the highest level of stretch of the fabric is at least 12% and wherein the bonds are spaced at about 4 to 8 bonds per cm and have a density of about 16 to 62 per $cm^2$; wherein the multiple component fibers comprise bicomponent fibers including two distinct polymers selected from the group consisting of poly(ethylene terephthalate), poly(trimethylene terephthalate), poly(tetramethylene terephthalate), said bicomponent fibers having an arrangement selected from eccentric sheath-core and side-by side.

* * * * *